US010676866B2

(12) United States Patent
Brujas et al.

(10) Patent No.: US 10,676,866 B2
(45) Date of Patent: Jun. 9, 2020

(54) DRYING ROLLER AND A METHOD FOR MANUFACTURING THE SAME

(71) Applicant: VOITH PATENT GMBH, Heidenheim (DE)

(72) Inventors: Marco Brujas, Sao Paulo (BR); Robson Consolato, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 77 days.

(21) Appl. No.: 16/030,295

(22) Filed: Jul. 9, 2018

(65) Prior Publication Data

US 2018/0320313 A1 Nov. 8, 2018

Related U.S. Application Data

(62) Division of application No. 14/902,887, filed as application No. PCT/EP2014/061330 on Jun. 2, 2014, now Pat. No. 10,066,340.

(30) Foreign Application Priority Data

Jul. 5, 2013 (DE) ..... 10 2013 213 194

(51) Int. Cl.
*D21F 5/02* (2006.01)

(52) U.S. Cl.
CPC ..... *D21F 5/028* (2013.01); *D21F 5/021* (2013.01)

(58) Field of Classification Search
CPC . D21F 5/02; D21F 5/021; D21F 5/022; D21F 5/028
USPC .... 34/110, 454; 219/101, 102, 104, 105, 57, 219/58; 228/168, 169, 189
See application file for complete search history.

(56) References Cited

U.S. PATENT DOCUMENTS 1,655,931 A 1/1928 Langstroth ..... B23K 9/0026 196/133
1,736,539 A * 11/1929 Lachman ..... B23K 11/14 52/468
1,810,825 A * 6/1931 Furrer ..... F16L 13/0227 285/22
1,872,240 A * 8/1932 Burnish ..... B23K 5/22 219/137 R (Continued)

FOREIGN PATENT DOCUMENTS

CN 1105079 A 7/1995
CN 2459134 Y 11/2001

(Continued)

OTHER PUBLICATIONS

Author not named, "AS 1210-1997 (Incorporating Amendment Nos. 1, 2, and 3) Australian Standard—Pressure Vessels", XP003032119.

*Primary Examiner* — Jason L Vaughan
(74) *Attorney, Agent, or Firm* — Laurence A. Greenberg; Werner H. Stemer; Ralph E. Locher

(57) ABSTRACT

A drying roller includes at least a cylindrical cylinder shell, two caps which are attached to both sides of the cylinder shell, and two journals which are indirectly fastened to the caps by way of a hollow shaft which is connected to the caps or are directly fastened to the caps, wherein the cylinder shell and the caps are welded to one another by way of an annular weld seam. The weld seam has a joint having at least two mutually opposite and parallel flange regions which are mutually spaced apart. A method for manufacturing a drying roller is also described.

7 Claims, 2 Drawing Sheets

(56) References Cited

U.S. PATENT DOCUMENTS

| | | | | | |
|---|---|---|---|---|---|
| 1,946,494 | A | * | 2/1934 | Horton | 220/581 |
| 1,987,341 | A | * | 1/1935 | Kachel | F16L 13/0227 228/175 |
| 2,179,774 | A | | 11/1939 | Zerbe | B23K 5/006 219/137 R |
| 2,328,321 | A | | 8/1943 | Berry | D21F 5/02 34/108 |
| 3,061,944 | A | | 11/1962 | Kraus | D21F 5/02 15/256.5 |
| 3,116,965 | A | | 1/1964 | Kraus | C22C 9/01 15/256.5 |
| 3,365,566 | A | | 8/1965 | Kuder | |
| 3,299,531 | A | | 1/1967 | Kutchera | D21F 5/02 165/90 |
| 3,629,932 | A | * | 12/1971 | Richter | B23K 9/23 228/172 |
| 3,633,662 | A | | 1/1972 | Voll | |
| 3,733,686 | A | * | 5/1973 | Maucher | B23K 9/23 228/165 |
| 3,773,614 | A | | 11/1973 | Pennington | B01D 33/067 162/357 |
| 3,781,957 | A | | 1/1974 | Luthi | D21F 5/182 492/32 |
| 3,911,595 | A | | 10/1975 | Lande | F26B 13/14 165/90 |
| 3,986,784 | A | * | 10/1976 | Eftefield | B23K 9/035 403/272 |
| 4,209,123 | A | * | 6/1980 | Jay | B23K 9/232 228/175 |
| 4,234,119 | A | | 11/1980 | Masaoka | B23K 9/0216 219/137 R |
| 4,320,582 | A | | 3/1982 | Klippstein | D21F 5/021 165/89 |
| 4,348,041 | A | * | 9/1982 | Imai | F16L 13/0236 285/288.2 |
| 5,248,080 | A | * | 9/1993 | Stapleton | B23K 31/02 228/175 |
| 6,018,870 | A | | 2/2000 | Marschke | D21F 5/021 29/895.2 |
| 6,942,606 | B2 | | 9/2005 | Womer | F28F 5/02 492/43 |
| 8,398,822 | B2 | | 3/2013 | Mennucci | D21F 5/021 162/357 |
| 8,438,752 | B2 | | 5/2013 | Mennucci et al. | |
| 9,206,549 | B2 | | 12/2015 | Cederloef | F26B 13/183 |
| 9,403,243 | B2 | | 8/2016 | Krasser | D21F 5/021 |
| 2009/0224530 | A1 | | 9/2009 | Sessions | B23K 9/0209 285/31 |
| 2010/0132903 | A1 | | 6/2010 | Mennucci et al. | |
| 2015/0240420 | A1 | | 8/2015 | Cederloef et al. | |

FOREIGN PATENT DOCUMENTS

| | | | |
|---|---|---|---|
| CN | 100999036 | A | 7/2007 |
| CN | 101641475 | A | 2/2010 |
| CN | 101829838 | A | 9/2010 |
| CN | 104781468 | A | 7/2015 |
| DE | 1095089 | B | 12/1960 |
| DE | 2707923 | A1 | 8/1978 |
| DE | 102008002259 | A1 | 12/2009 |
| DE | 202007019227 | U1 | 5/2011 |
| EP | 1614799 | A1 | 1/2006 |
| WO | 2008105005 | A1 | 9/2008 |

* cited by examiner

DRYING ROLLER AND A METHOD FOR MANUFACTURING THE SAME

CROSS-REFERENCE TO RELATED APPLICATION

This application is a divisional of patent application Ser. No. 14/902,887, filed Jan. 5, 2016; which was a § 371 national stage filing of international application No. PCT/EP2014/061330, filed Jun. 2, 2014, which designated the United States; this application also claims the priority, under 35 U.S.C. § 119, of German patent application No. 10 2013 213 194.1, filed Jul. 5, 2013; the prior applications are herewith incorporated by reference in their entirety.

BACKGROUND OF THE INVENTION

Field of the Invention

The invention relates to drying rollers which are at least composed of a cylindrical cylinder shell, of two caps which are attached to both sides of the cylinder shell, and of two journals which are indirectly fastened to the caps by way of a hollow shaft which is connected to the caps or are directly fastened to the caps, wherein the cylinder shell and the caps are welded to one another by way of an annular weld seam.

A drying roller or drying cylinder for drying webs of cellulose or paper, which comprises a shell and caps which are disposed on the ends of the shell, is known from DE 27 07 923 A1. In order to avoid flexural tension during welding of the shell and of the caps, a transitional piece adjoins the weld seam on that side of the latter that faces away from the shell periphery, which transitional piece when viewed in an axial section through the cylinder in the seam region has approximately the thickness of the shell, wherein the transitional piece and the shell in the seam region have a constant profile.

US 2010/0132903 A1 moreover shows for example a drying roller of similar construction, manufactured from steel, in which caps are welded to the ends of a cylinder shell by means of an encircling weld seam which is configured between mutually opposite faces of each of the caps and of the cylinder shell. The weld seam is composed of a clearance having a U-shaped cross section, which is open toward the outer face of the cylinder shell and which is configured by respective depressions between a respective end of the cylinder shell and one of the caps and is filled by means of weld material, wherein a counter bead is provided on the inner face of the cylinder shell, so as to be level with the clearance.

In drying rollers of this type the quality of the weld seam between the cylinder shell and the cap can only be checked with difficulty. Here, checking the quality of welding in particular in the base region of the weld seams is problematic and in most cases can only be measured using radiographic methods.

BRIEF SUMMARY OF THE INVENTION

It is thus the object of the present invention to provide drying rollers having operationally safe weld seams, and methods for manufacturing drying rollers of this type.

This object is achieved by drying rollers having at least a cylindrical cylinder shell, two caps attached to both sides of the cylinder shell, and two journals indirectly fastened to the caps by way of a hollow shaft connected to the caps or directly fastened to the caps, wherein the cylinder shell and the caps are welded to one another by way of an annular weld seam. This object is also achieved by methods for manufacturing a drying roller at least composed of a cylindrical cylinder shell, two caps attached to both sides of the cylinder shell, and two journals indirectly fastened to the caps by way of a hollow shaft connected to the caps or directly fastened to the caps, wherein the cylinder shell and the caps are welded to one another by way of an annular weld seam. The dependent claims relate to preferred embodiments.

Here the invention is based on the common inventive concept of ensuring the quality of the weld seam between the cylinder shell and the caps by a suitable design embodiment of the cylinder shell and of the caps in the vicinity of the weld seam.

In this way, a drying roller may be at least composed of a cylindrical cylinder shell, of two caps which are attached to both sides of the cylinder shell, and of two journals which are indirectly fastened to the caps by way of a hollow shaft which is connected to the caps or are directly fastened to the caps, wherein the cylinder shell and the caps are welded to one another by way of an annular weld seam, and wherein the weld seam has a joint having at least two mutually opposite and parallel flange regions which are mutually spaced apart.

Because the weld seam in a drying roller of this type has a joint having at least two mutually opposite and parallel flange regions which are mutually spaced apart, or in other words has a joint having a web and a web spacing, beads which form a root position of the weld seam may also be welded in a reliable manner from the outside. On account thereof, the quality of the formed weld seam may be improved and the overall operational reliability of the same be enhanced. On account thereof, it is thus possible for drying rollers having operationally reliable weld seams to be provided and methods for the manufacture thereof to be stated.

A drying roller of this type may be adapted for various applications in paper manufacturing, for example for drying various types of paper. For example, the drying roller may be in particular a so-called Yankee roller which is provided for drying so-called tissue paper or sanitary paper or soft paper. But even so-called MG (machine glazed) rollers for the manufacture of machine-smoothed papers are implementable using drying rollers of this type. Furthermore, the drying roller may be employed in the manufacture of cardboard paper or art paper. Yankee rollers and MG rollers typically have two journals which are indirectly fastened by way of a hollow shaft which is connected to the caps, while drying rollers for the manufacture of cardboard paper and art paper often have journals which are directly fastened to the caps.

During drying the material to be dried, such as paper or cardboard paper, usually is in direct contact with the outer surface of the cylinder shell which on the inner side at least in portions may have a smooth surface or at least in portions may be provided with one or a plurality of grooves or channels which may also be provided in flaring-type bolsters, so as to counteract stress which under certain circumstances may act on the drying roller from outer pressure rollers or pressure cylinders. The caps of the drying roller may be configured in a disk-like manner. For example, at least one of the caps may be a flat disk. However, at least one of the caps may also have a domed shape which is similar for example to a torispherical head or a dished boiler end, or be configured having a semi-elliptical cross section. The hollow shaft may be provided for mounting the drying roller, wherein the former reduces any tension acting on the cylinder shell or the caps. The hollow shaft is usually of cylindrical shape, having flat or conical end portions. Said hollow shaft may be configured so as to be integral or multi-partite having two or more interconnected segments which are, for example, welded, brazed, screwed, locked, or connected by means of bolts. In some embodiments the hollow shaft is configured so as to be integral with the journals. Furthermore, the journals are usually inserted in corresponding bearings or bearing housings which support the entire assembly of the drying roller and enable rotating movement of the drying roller. Components of the drying roller here may be made from various materials and in particular from metals such as steel, stainless steel, carbon steel, cast steel, or cast iron.

In one embodiment of a drying roller, the weld seam is welded so as to be without a counter bead, on account of which the process reliability in the manufacture of the weld seam is improved, since the weld seam is executed in a particularly simple manner.

Furthermore, a drying roller may be at least composed of a cylindrical cylinder shell, of two caps which are attached to both sides of the cylinder shell, and of two journals which are indirectly fastened to the caps by way of a hollow shaft which is connected to the caps or are directly fastened to the caps, wherein the cylinder shell and the caps are welded to one another by way of an annular weld seam, wherein the radially inward workpiece faces of both the cap as well as of the cylinder shell on both sides of the weld seam are configured so as to be cylindrical and wherein a closable or closed inspection opening is provided in at least one cap.

In an embodiment of this type of a drying roller the inspection opening may be identical to a hole for the hollow shaft or the journals. Alternatively, a further opening for the hollow shaft or the journals may be provided in addition to the inspection opening. The inspection opening may be designed as a manhole, depending on the size of the drying roller.

Furthermore, the drying roller may be at least composed of a cylindrical cylinder shell, of two caps which are attached to both sides of the cylinder shell, and of two journals which are indirectly fastened to the caps by way of a hollow shaft which is connected to the caps or are directly fastened to the caps, wherein the cylinder shell and the caps are welded to one another by way of an annular weld seam, wherein the radially inward workpiece face of the cylinder shell between a condenser and the weld seam is configured so as to be cylindrical.

Also, a drying roller which is configured in this manner, that is to say is provided on both sides of the weld seam with cylindrically configured and radially inward workpiece faces of both the cap as well as of the cylinder shell, or is provided between a condenser and the weld seam with a cylindrically configured and radially inward workpiece face of the cylinder shell, is distinguished by good accessibility to the weld seam even from the interior, on account of which the possibilities for checking the weld seam using various testing methods are improved, on account of which the quality of the weld seam may be ensured. In particular, the weld seam of a drying roller configured in such a manner may be selectively tested by means of x-rays, ultrasound, penetration testing in the form of color-penetration methods, and/or by magnetic particles, but not limited thereto.

The condenser advantageously here has one, preferably a plurality of encircling grooves. The higher the number of grooves, the better the effectiveness of the condenser.

Preferably, a machined transitional radius and/or a transitional groove preferably having at least one machined transitional radius between the groove flank of the transitional groove and the groove base of the transitional groove is provided between the cylindrical inward workpiece face of the cylinder shell and the condenser. On account thereof, particularly high stability of the drying roller is achieved while providing good inspection possibilities. The transitional radius and/or the transitional groove may be manufactured in particular by milling or turning.

In a method for manufacturing a drying roller at least composed of a cylindrical cylinder shell, of two caps which are attached to both sides of the cylinder shell, and of two journals which are indirectly fastened to the caps by way of a hollow shaft which is connected to the caps or are directly fastened to the caps, wherein the cylinder shell and the caps are welded to one another by way of an annular weld seam, prior to the cap being welded to the cylinder shell a spacing between the cap and the cylinder shell which are in each case to be welded together may be defined by way of at least one spacer, so as to provide an operationally reliable weld seam in this way.

This method permits in particular the manufacture of a drying roller having an encircling weld seam between the cylinder shell and the cap, which has a joint having at least two mutually opposite and parallel flange regions which are mutually spaced apart.

Preferably, the cap and the cylinder shell which are in each case to be welded together are initially tacked to one another by tack welding and only thereafter are welded to one another by weld beads. Here, tack welding permits preliminary fixing of the cap to the cylinder shell, prior to the final connection being performed by welding by way of weld beads. In this way, inaccuracies in positioning the cap may still be corrected prior to final welding.

The spacer may be an annular spacer which ensures a constant spacing between the cap and the cylinder shell along the circumference of the drying roller. Alternatively, annular segments or separate spacers having a defined width may likewise be employed.

Furthermore, in a method for manufacturing a drying roller at least composed of a cylindrical cylinder shell, of two caps which are attached to both sides of the cylinder shell, and of two journals which are indirectly fastened to the caps by way of a hollow shaft which is connected to the caps or are directly fastened to the caps, wherein the cylinder shell and the caps are welded to one another by way of an annular weld seam, after the cap has been welded to the cylinder shell the weld seam may be checked from the inside through an inspection opening.

As a result of the weld seam being checked from the inside through the inspection opening, the overall operational reliability of the weld seam is improved, since faulty weld seams may be repaired immediately. The most varied of testing methods may then also be applied.

Preferably, the radially inward workpiece faces of both the cap as well as of the cylinder shell on both sides of the weld seam are configured so as to be cylindrical. A configuration of this type of the radially inward workpiece faces permits simple and operationally reliable inspections to be performed by means of the most varied of inspection installations. Suitable inspection installations may be x-ray apparatus or ultrasound apparatus, for example. Moreover, inspections for example by means of color-penetration testing or magnetic powder testing or other methods may be performed.

It is to be understood that the features of the solutions described above or in the claims, respectively, may optionally also be combined so as to be able to implement the advantages in a correspondingly cumulative manner.

BRIEF DESCRIPTION OF THE SEVERAL VIEWS OF THE DRAWING

Further advantages, objectives, and properties of the present invention will be explained by means of the following description of exemplary embodiments which are also illustrated in particular in the appended drawing, in which.

DESCRIPTION OF THE INVENTION

Figure 1:
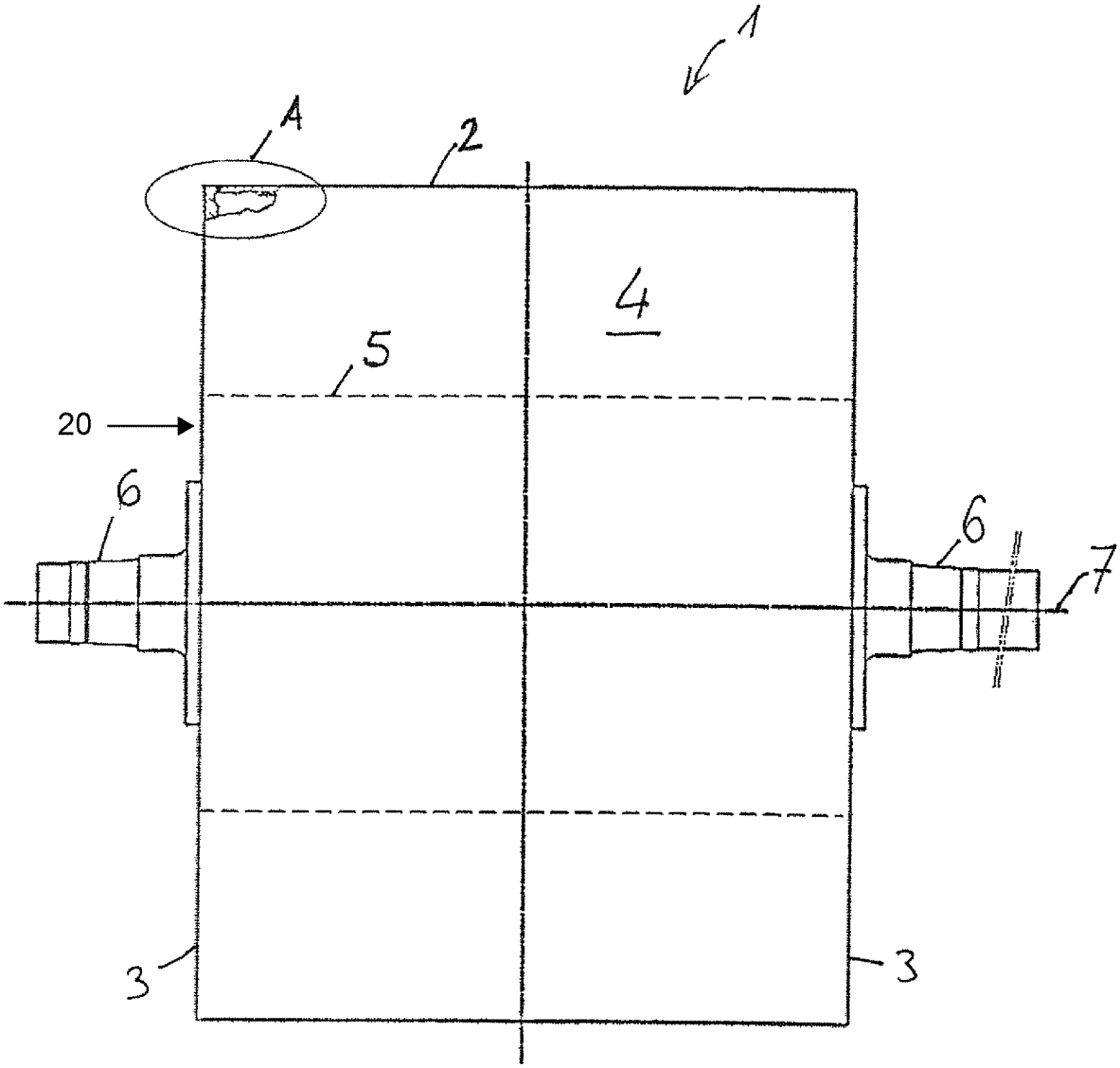
FIG. 1 schematically shows an exemplification of a drying roller.

A substantially cylindrical drying roller 1 which is exemplified in FIG. 1 comprises a cylinder shell 2 and two caps 3 which are attached to both sides of the cylinder shell 2 and which by means of an annular weld seam (not visible in FIG. 1) are welded to the cylinder shell 2. In an interior space 4 which is enclosed by the cylinder shell 2 and the caps 3, the drying roller 1 furthermore has a hollow shaft 5 which extends between the caps 3 and is provided with through openings. In each case one journal 6 is provided on an outer face of each of the caps 3. The cylinder shell 2, the caps 3, the hollow shaft 5, and the journals 6 here are disposed coaxially along a longitudinal axis 7, such that an overall axially symmetrical construction of the drying roller 1 results. The drying roller 1, by means of the journals 6, may be mounted in suitable bearings (not illustrated in FIG. 1) so as to be rotatable about the longitudinal axis 7. The hole provided for the hollow shaft 5 may also serve as an inspection opening 20 for inspecting the annular weld seam 8 (which is not visible in FIG. 1, but is shown in FIG. 2) Alternatively, an additionally provided hole can serve as an inspection opening.

During operation of the drying roller 1 the outer face of the cylinder shell 2 is at least partially wrapped by paper to be dried, or paper to be dried is overlaid onto the outer face of the cylinder shell 2, respectively. Pressure rollers (not shown in FIG. 1) here press the overlaid paper against the cylinder shell 2. Hot steam, having a pressure of usually 3 to 8 bar and which may be up to 12 bar or more, is directed via the hollow shaft 5 into the interior space 4. A drying operation of the paper overlaid on the cylinder shell 2 by means of a heat exchange between the surface of the cylinder shell 2, which as a result of the hot steam in the interior space 4 is hot, and the paper now takes place.

Figure 2:
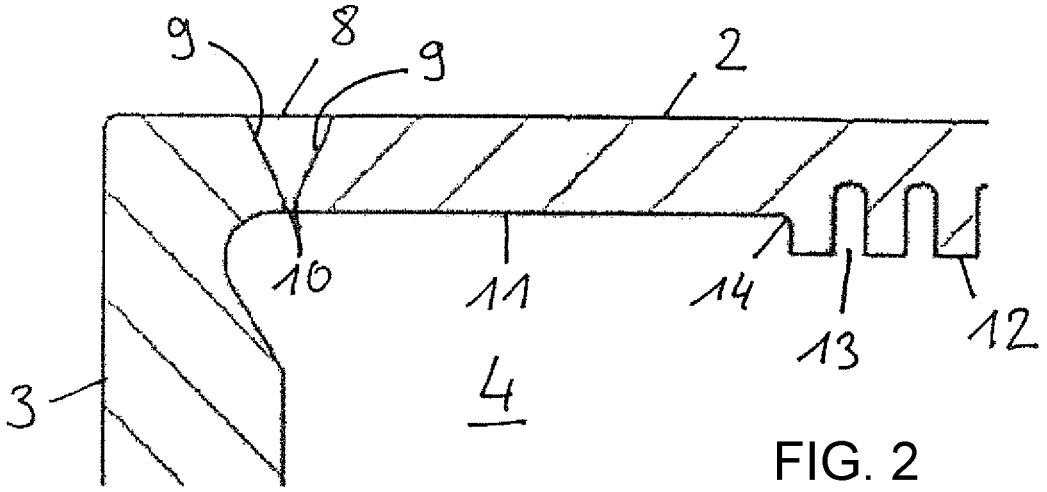
FIG. 2 shows a part-region of the exemplification of FIG. 1.

A part-region of the drying roller 1, which in FIG. 1 is identified with A, is illustrated in an enlarged manner and in cross section in FIG. 2, wherein part of one of the caps 3 and part of the cylinder shell 2, and between those the weld seam 8 which has already been mentioned above, can be seen. It may be derived from FIG. 2 in particular that mutually facing faces of both the cap 3 as well as of the cylinder shell 2, which belong to the joint of the weld seam, have in each case first flange regions 9 which are sloped toward one another, and second flange regions 10 which are parallel with one another and are mutually spaced apart. A substantially V-shaped cross section of the weld seam 8, which widens toward the outer side of the cylinder shell 2 and tapers off toward the interior space 4, thus results, wherein said weld seam 8 by way of a groove-shaped portion which is delimited by the second flange regions 10 opens into the interior space 4.

An end portion 11 of the cylinder shell, which faces the weld seam 8, on a face which faces the interior space 4 is configured so as to be cylindrical, that is to say to be free of any elevations or depressions. A portion having a plurality of grooves 13, which run along the circumference and are disposed in succession along the longitudinal axis 7, which becomes thicker toward the interior space 4 and is configured as a condenser 12 adjoins this end portion 11. A transition between the end portion 11 and the condenser 12 here has a transitional radius 14.

Also, the cap 3 in the region of the weld seam 8 is configured so as to be cylindrical toward the interior space 4, so that the radially inward workpiece faces of both the cap 3 as well as of the cylindrical shell 2 on both sides of the weld seam 8 are configured so as to be cylindrical.

As a result of the groove-shaped portion which opens out into the interior space 4 it is possible for the weld seam 8 having a substantially V-shaped cross section to be provided with a counter bead. Moreover, the cylindrical end portion 11 as well as the cylindrically configured and radially inward workpiece faces of both the cap 3 as well as of the cylinder shell 2, which are on both sides of the weld seam 8, enable simple checking of the weld seam 8 by visual means or by means of a suitable testing method using, for example, x-rays or ultrasound, or by means of color-penetration testing or magnetic powder testing.

The weld seam 8 may also be configured so as to have a U-shaped, K-shaped, X-shaped, double-U-shaped or otherwise shaped cross section instead of a V-shaped cross section.

Figure 3:
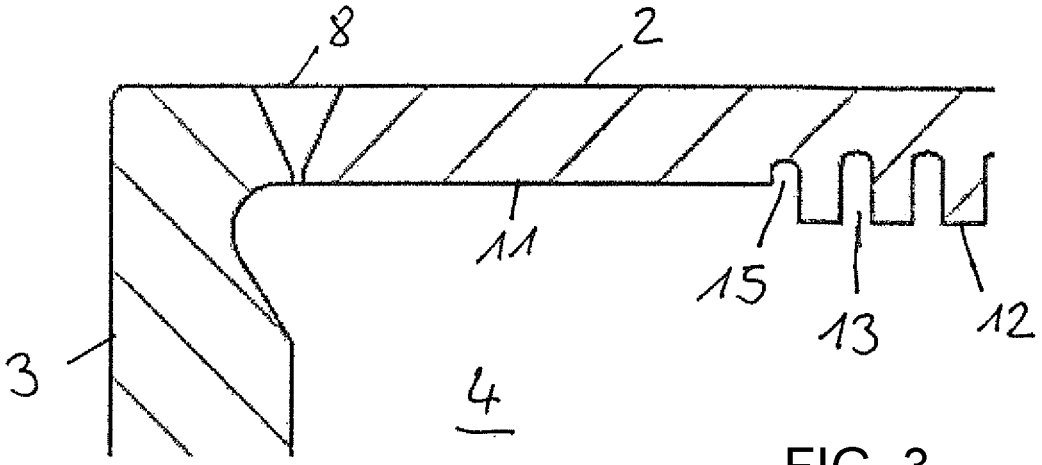
FIG. 3 shows an exemplified part-region of a drying roller having a transitional groove, in an illustration which is similar to FIG. 2.

In the embodiment which is exemplified in FIG. 3, a circumferential transitional groove 15 instead of a radius has been configured for the transition from the cylindrical end portion 11 to the condenser 12. The depth of said transitional groove 15 in the present case is equal to the depth of the grooves 13 of the condenser 12; however, said transitional groove 15 may also have a depth which is different from that of the grooves 13.

Figure 4:
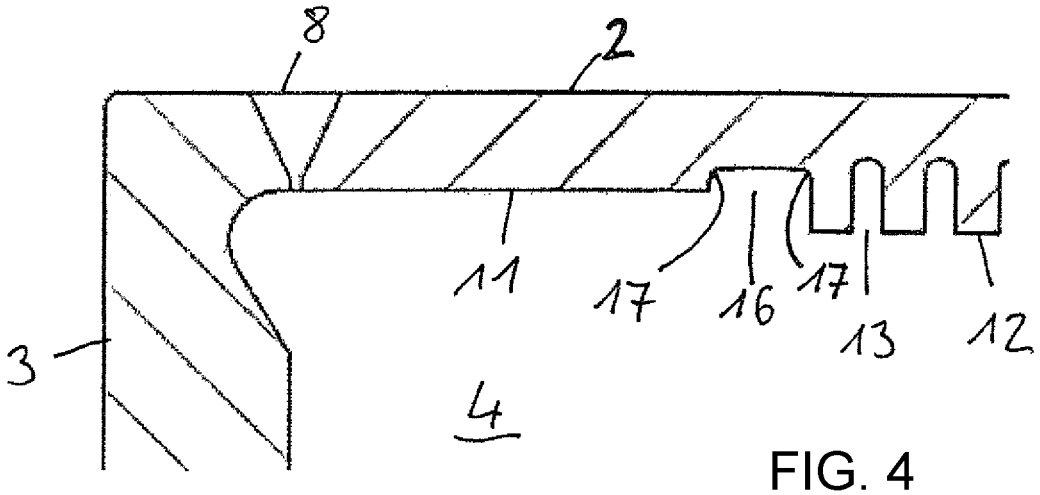
FIG. 4 shows an exemplified part-region of a drying roller having a step-like transitional groove, in an illustration which is similar to FIGS. 2 and 3.

By contrast, in the embodiment which is exemplified in FIG. 4, a wide step-like transitional groove 16 instead of the transitional groove 15 of FIG. 3 has been configured. The width of said transitional groove 16 is only limited by the width of the end portion 11. A transitional radius 17 is in each case provided between respective groove flanks of the transitional groove 16, which are perpendicular to the longitudinal axis 7, and a groove base of the transitional groove 16, which is parallel to the longitudinal axis 17.

The following is a summary list of reference numerals and the corresponding structure used in the above description of the invention:

1 Drying roller
2 Cylinder shell
3 Cap
4 Interior space
5 Hollow shaft
6 Journal
7 Longitudinal axis
8 Weld seam
9 First flange region

10 Second flange region
11 End portion
12 Condenser
13 Groove
14 Transitional radius
15 Transitional groove
16 Transitional groove
17 Transitional radius

The invention claimed is:

1. A method for manufacturing a drying roller, the method comprising the following steps:

providing a cylindrical cylinder shell having two sides;

attaching a respective cap to each of the sides of the cylinder shell;

fastening a respective journal to each of the caps; and then welding the cylinder shell and the caps to one another by using an annular weld seam having a joint with at least two mutually opposite and parallel flange regions being mutually spaced apart, said parallel flange regions extending to said interior of said cylindrical cylinder shell, said parallel flange regions forming a minority portion of said joint.

2. The manufacturing method according to claim 1, which further comprises interconnecting each of the journals and a respective one of the caps by using a hollow shaft.

3. The manufacturing method according to claim 1, which further comprises initially tacking each of the caps and the cylinder shell to be welded together to one another by tack welding and only thereafter welding the caps and the cylinder shell to one another by weld beads.

4. The manufacturing method according to claim 1, wherein the at least one spacer is at least one annular spacer.

5. A method for manufacturing a drying roller, the method comprising the following steps:

providing a cylindrical cylinder shell having two sides;

attaching a respective cap to each of the sides of the cylinder shell;

fastening a respective journal to each of the caps;

welding the cylinder shell and the caps to one another by an annular weld seam having a joint with at least two mutually opposite and parallel flange regions being mutually spaced apart, said parallel flange regions extending to said interior of said cylindrical cylinder shell, said parallel flange regions forming a minority portion of said joint; and after the caps have been welded to the cylinder shell, checking the weld seam from inside through an inspection opening.

6. The manufacturing method according to claim 5, which further comprises interconnecting each of the journals and a respective one of the caps by using a hollow shaft.

7. The manufacturing method according to claim 5, wherein the caps and the cylinder shell on both sides of the weld seam have cylindrical radially inward workpiece faces.

* * * * *